United States Patent [19]

Braun

[11] Patent Number: 4,879,506

[45] Date of Patent: Nov. 7, 1989

[54] SHUNT REGULATOR

[75] Inventor: Jeffrey J. Braun, Mesa, Ariz.

[73] Assignee: Motorola, Inc., Schaumburg, Ill.

[21] Appl. No.: 227,384

[22] Filed: Aug. 2, 1988

[51] Int. Cl.[4] ..... G05F 3/20

[52] U.S. Cl. ..... 323/314; 323/316; 330/288

[58] Field of Search ..... 323/313, 314, 315, 316; 307/296 R, 297; 330/288, 289

[56] References Cited

U.S. PATENT DOCUMENTS

| | | | |
|---|---|---|---|
| 3,887,863 | 6/1975 | Brokaw | 323/314 |
| 4,362,985 | 12/1982 | Tsuchiya | 323/314 |
| 4,477,737 | 10/1984 | Ulmer et al. | 323/316 X |
| 4,495,425 | 1/1985 | McKenzie | 323/313 X |
| 4,507,573 | 3/1985 | Nagano | 323/315 X |
| 4,645,998 | 2/1987 | Shinohara et al. | 323/313 |

*Primary Examiner*—Patrick R. Salce
*Assistant Examiner*—Kristine Peckman
*Attorney, Agent, or Firm*—Michael D. Bingham

[57] ABSTRACT

A voltage supply circuit provides a desired regulated voltage at an output utilizing a PNP and an NPN current mirror arranged to oppose one another. The NPN current mirror includes a pair of transistors operated at different current densities which produce a delta $V_{BE}$ voltage that is used to produce a reference current. The reference current is used to derive the regulated voltage which is a function of two independent resistor ratios.

2 Claims, 1 Drawing Sheet

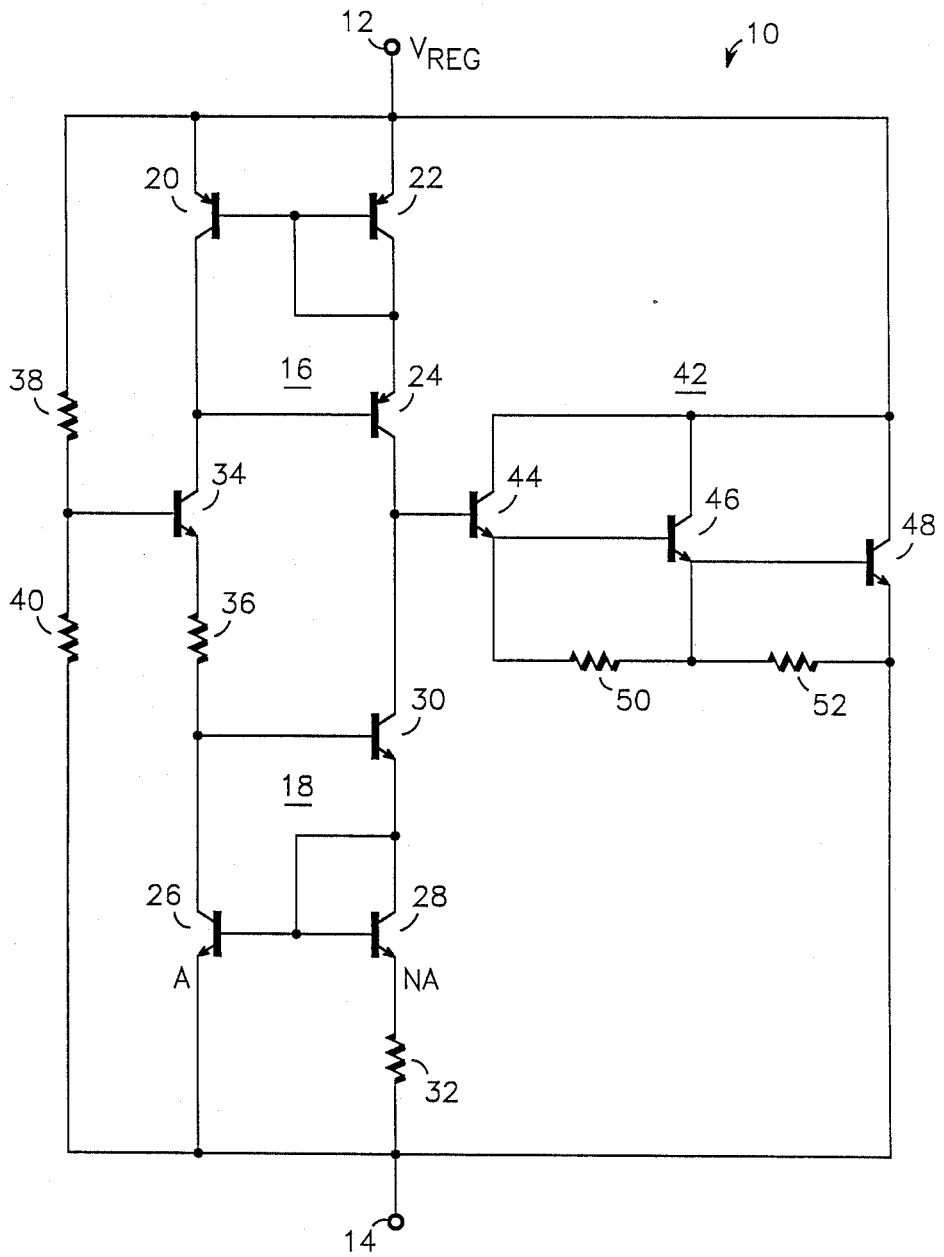
12
$V_{REG}$
10
20
22
16
24
42
38
34
44
46
48
40
36
50
52
30
18
26
28
A
NA
32
14

SHUNT REGULATOR

BACKGROUND OF THE INVENTION

The present invention relates to voltage supply circuits and, more particularly, to a circuit for providing a regulated output voltage at an output that is suited to drive a load coupled in shunt thereto.

Regulated voltage supplies are well known in the art. One prior art regulator uses a pair of transistors operated at different current densities to provide a positive temperature coefficient (TC) voltage. This voltage is combined with a second voltage having a negative TC in a complementary sense to produce an essentially zero TC voltage. Regulation is provided using feedback to the bases of the two transistors. Although this prior art regulated voltage supply works quite well, there is no provision for providing a wide range of TC adjustment independent of the output voltage.

Hence, a need exists for an improved regulator circuit which requires a minimum of components and in which the regulated output voltage can be adjusted independent of the TC of the regulator using resistor ratios.

SUMMARY OF THE INVENTION

Accordingly, it is an object of the present invention to provide an improved regulated voltage supply.

Another object of the present invention is to provide an improved shunt regulator the regulation voltage of which can be adjusted independent of the TC of the regulator using two independent resistor ratios.

In accordance with the above and other objects there is provided an improved regulated voltage supply comprising a pair of opposing current mirrors coupled in series with one of the current mirrors providing a positive TC voltage that is used to derive a reference current for the current mirrors; the reference current is used to develop a first voltage the magnitude of which is determined by a first resistor ratio; this first voltage is multiplied by a ratio factor set by a second resistor ratio that is independent of the first resistor ratio to produce the regulated output voltage.

BRIEF DESCRIPTION OF THE DRAWING

The single FIGURE is a schematic diagram illustrating the regulator circuit of the preferred embodiment.

DETAILED DESCRIPTION OF THE PREFERRED EMBODIMENT

Turning to the sole FIGURE there is shown regulator circuit 10 of the present invention which provides a regulated voltage, $V_{REG}$, at output terminal 12. Typically, terminal 12 is returned to a positive operating potential via, for instance, a resistor. $V_{REG}$ is therefore supplied to an utilization means that would be coupled in parallel to terminals 12 and 14. Regulator 10 is comprised of current mirror 16 coupled to opposing current mirror 18, between terminals 12 and 14. Current mirror 16 is a well known PNP "Wilson" type current source including transistors 20, 22 and 24 having a common terminal (the interconnected emitters of transistors 20 and 22) coupled to terminal 12 for providing first and second currents through the emitter-collector conduction paths of transistors 20 and 24. Transistor 22, which has its collector shorted to its base the latter of which is also coupled to the base of transistor 20, mirrors the current flowing through transistor 20. Hence, as will be described later, at regulation, the current sourced at the collector of transistor 20 is substantially equal to the current sourced at the collector of transistor 24. Current mirror 18 is the NPN complement of current mirror 16 with the collector of transistor 30 being coupled to the collector of transistor 24. The collector-emitter conduction path of transistor 30 is coupled in series with the collector-emitter conduction path of transistor 28 while the base of the former is coupled to the collector of transistor 26. Transistor 28, similarly to transistor 22, is connected as a diode as its collector is shorted to its base. The base of transistor 26 is coupled to the base of transistor 28. As is illustrated, the emitter area of transistor 28 is N times the emitter area, A, of transistor 26. The emitter of transistor 26 is directly coupled to terminal 14 while that of transistor 28 is coupled to the same terminal through resistor 32. The collector-emitter conduction path of transistor 34 is coupled in series with resistor 36 between the collectors of transistors 20 and 26 while its base is coupled to the interconnection of resistors 38 and 40. Resistors 38 and 40 form a resistive divider circuit between terminals 12 and 14. A Darlington output stage 42 is provided between the interconnected collectors of transistors 24 and 30 and the terminals 12 and 14. Darlington stage 42 includes triple connected transistors 44, 46 and 48 as well as resistors 50 and 52.

In operation, current mirror 16 will source equal currents from the collector-emitter conduction paths of transistors 20 and 22, assuming these transistors are matched devices. If current mirror 18 is equal to current mirror 16, the two currents flowing in the aforementioned two current conduction paths will also flow through the collector-emitter conduction paths of transistors 26 and 28. However, since the emitter area of transistor 28 is larger than the emitter area of transistor 26, the current densities of the two transistors are different whereby a delta $V_{BE}$ (base to emitter voltage) is developed across resistor 32 which has a positive temperature coefficient as is well understood. At regulation, the currents flowing in the two conduction paths are equal and have a magnitude that is determined by the resistance of resistor 32 and is equal to:

$$I = V_{BE}/R32 \quad (1)$$

where R32 is the resistance of resistor 32.

This current establishes a voltage drop at the emitter of transistor 34 having the value:

$$V = V_{BE26} + V_{BE30} + I(R36) \quad (2)$$

At regulation, the value of V will be equal to a value that forces zero current to be supplied to the base of transistor 44 of Darlington output stage 42. Hence, the regulated output voltage potential is set by the ratio of resistors 38 and 40 and is equal to:

$$V_{REG} = (V + V_{BE34}) \times (R38/R40) \quad (3)$$

Regulation is maintained by having feedback through the resistive network of resistors 38 and 40 to the base of transistor 34. This feedback will produce a difference in the currents flowing through transistors 24 and 30 wherein the conduction of Darlington output stage 42 is varied accordingly to force $V_{REG}$ to the value of equation 3.

Hence, regulator 10 provides an accurate regulated output voltage the magnitude of which can be adjusted to a predetermined value by the two independent resistor ratios, R36/R32 and R38/R40. In addition, the temperature coefficient of the regulator can be adjusted independently of the regulated output voltage by changing the emitter area ratio of transistors 26 and 28.

Thus, what has been described above is a novel shunt regulator circuit suited for manufacture integrated circuit form.

What is claimed is:

1. An integrated shunt regulator for providing a regulated voltage at an output thereof, comprising:

a first current mirror having a common terminal coupled to the output of the shunt regulator, and first and second terminals at which first and second currents are supplied;

a second current mirror having first and second terminals coupled to said first and second terminals of said first current mirror respectively and a common terminal, and including first and second transistors having a base, collector and emitter and operated at different current densities such that a voltage is produced there between having a positive temperature coefficient;

a first resistor coupled in series to the emitter of one of said first and second transistors across which said positive temperature voltage is developed;

a third transistor having a base, a collector coupled to said first terminal of said first current mirror and an emitter coupled to said first terminal of said second current mirror via said second resistor wherein a voltage is developed at said base which is a function of the current flowing in said first resistor; and a resistive divider coupled between the output of the regulator and said common terminal of said second current mirror and to said base of said third transistor for establishing the regulated voltage the magnitude of which is proportional to said voltage developed at said base of said third transistor.

2. The regulator of claim 1 including a Darlington output amplifier having an input coupled to said second terminals of said first and second current mirrors and an output coupled to the output of the regulator.

* * * * *